US005197714A

United States Patent [19]

Metzen

[11] Patent Number: 5,197,714

[45] Date of Patent: Mar. 30, 1993

[54] CAR LIFT

[75] Inventor: Wolfgang Metzen, Kell, Fed. Rep. of Germany

[73] Assignee: August Bilstein GmbH & Co. KG, Ennepetal, Fed. Rep. of Germany

[21] Appl. No.: 939,589

[22] Filed: Sep. 3, 1992

Related U.S. Application Data

[63] Continuation of Ser. No. 773,038, Oct. 8, 1991, abandoned.

[30] Foreign Application Priority Data

Nov. 12, 1990 [DE] Fed. Rep. of Germany ..... 9015483

[51] Int. Cl.[5] ..... B66F 3/12

[52] U.S. Cl. ..... 254/126

[58] Field of Search ..... 254/DIG. 1, 1, 101, 254/122, 124, 126, 98

[56] References Cited

U.S. PATENT DOCUMENTS 2,672,318 3/1954 Lee ..... 254/126

4,289,300 9/1981 Weisser et al. ..... 254/126

FOREIGN PATENT DOCUMENTS 9005572 8/1990 Fed. Rep. of Germany .

*Primary Examiner*—J. J. Swann

*Attorney, Agent, or Firm*—Max Fogiel

[57] ABSTRACT

An automotive jack in which an upright member is provided with a pivotable base plate hinged on a first pivot at the bottom of the upright member. This upright member has a second pivot on which a supporting arm is turnable. The supporting arm is pivoted by an actuating device. A spring pivots the base plate along the length of the upright member, and the supporting arm has, at one end, a load interception head for pivoting the base plate through a stop against the force of the spring into a position at an angle to the length of the upright member when the jack is folded together. The sole of the base plate has an entire surface butting against the ground for any extensions and loads of the jack due to the pivoting of the base plate about the first pivot.

8 Claims, 4 Drawing Sheets

CAR LIFT

The present application is a continuation of the parent application Ser. No. 773,038 filed Oct. 8, 1991, now abandoned.

BACKGROUND OF THE INVENTION

A jack of this type, with a base plate that pivots subject to the force of a spring into a ready position against an upright and returns to a fully horizontal position when the jack is folded together, is disclosed by German GM 9 005 572. The drawback to this embodiment is that it requires a special spring, which has to attach to the base plate in two different operating directions.

SUMMARY OF THE INVENTION

The object of the invention is to simplify the jack disclosed in GM 9 005 572 to the extent that any spring can be adapted to the specific embodiment to pivot the base plate against the upright, while ensuring that the base plate will pivot back again when the jack is folded together.

The advantages obtainable with the invention are in particular that the desired function can be carried out with few and simple components. The advantage of the embodiment is that the drive mechanism will not rattle around when the jack is folded together.

BRIEF DESCRIPTION OF THE DRAWINGS

One embodiment of the invention will now be specified with reference to the drawing, wherein.

DESCRIPTION OF THE PREFERRED EMBODIMENTS

Figure 1:
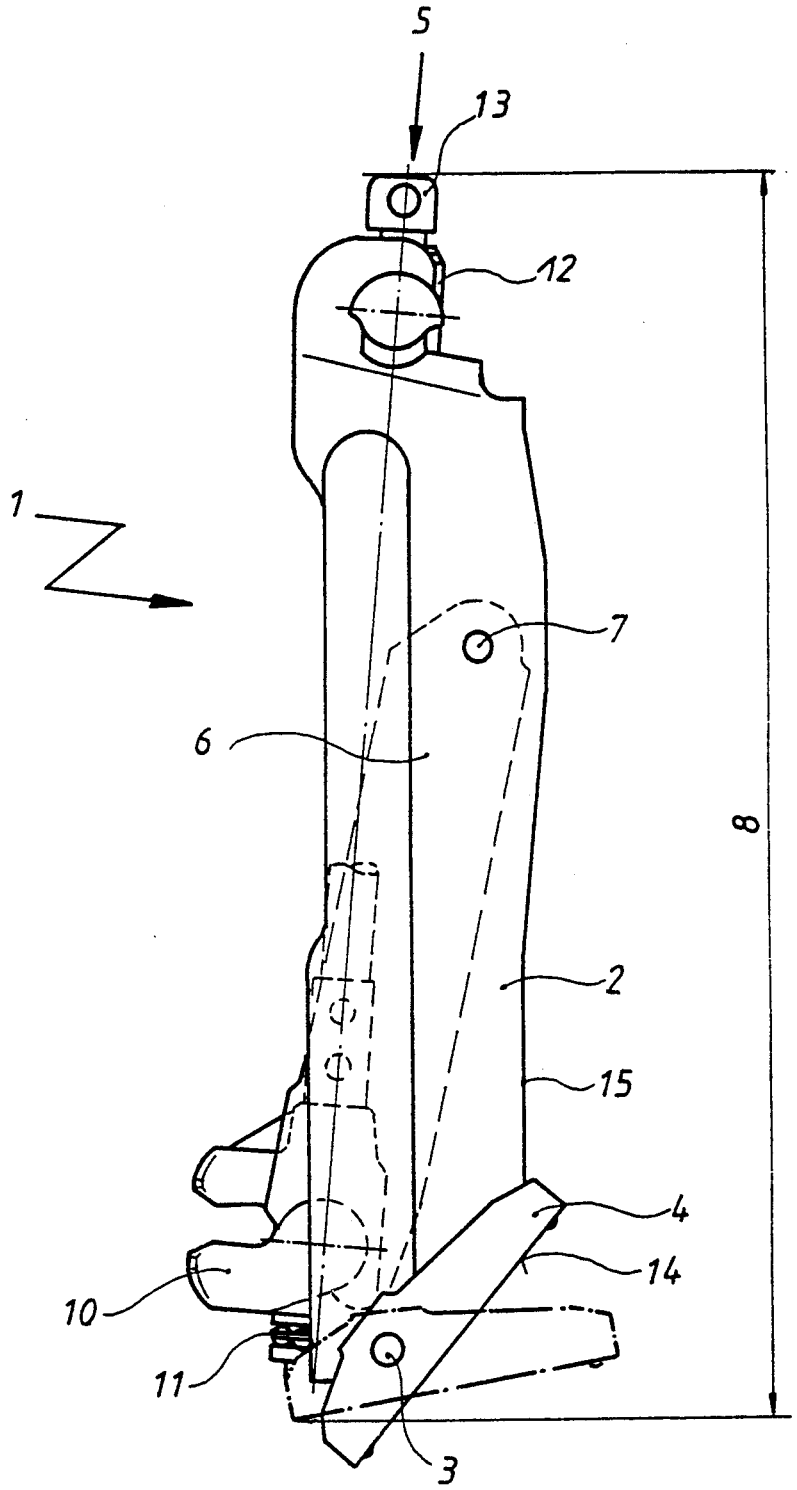
FIG. 1 is a view of an automotive jack.

As will be evident from FIG. 1, an automotive jack 1 has an upright 2 with a base plate 4 pivoting around an articulation 3. An activating mechanism 5, a threaded shaft in the present embodiment, swings a supporting arm 6 against upright 2 around a pivot 7.

The solid and dot-and-dash depictions of base plate 4 represent its two extreme positions. When it is in the position illustrated by the dot-and-dash lines, the jack will measure its minimal stowing length 8. The base plate is pivoted into the ready position by a spring mechanism 9, a single length of helical spring in the present embodiment, fitting around articulation 3, which is in the form of a pin.

Supporting arm 6 has a load-interception head 10 that accommodates an appropriate point on the vehicle and lifts it.

Figure 2:
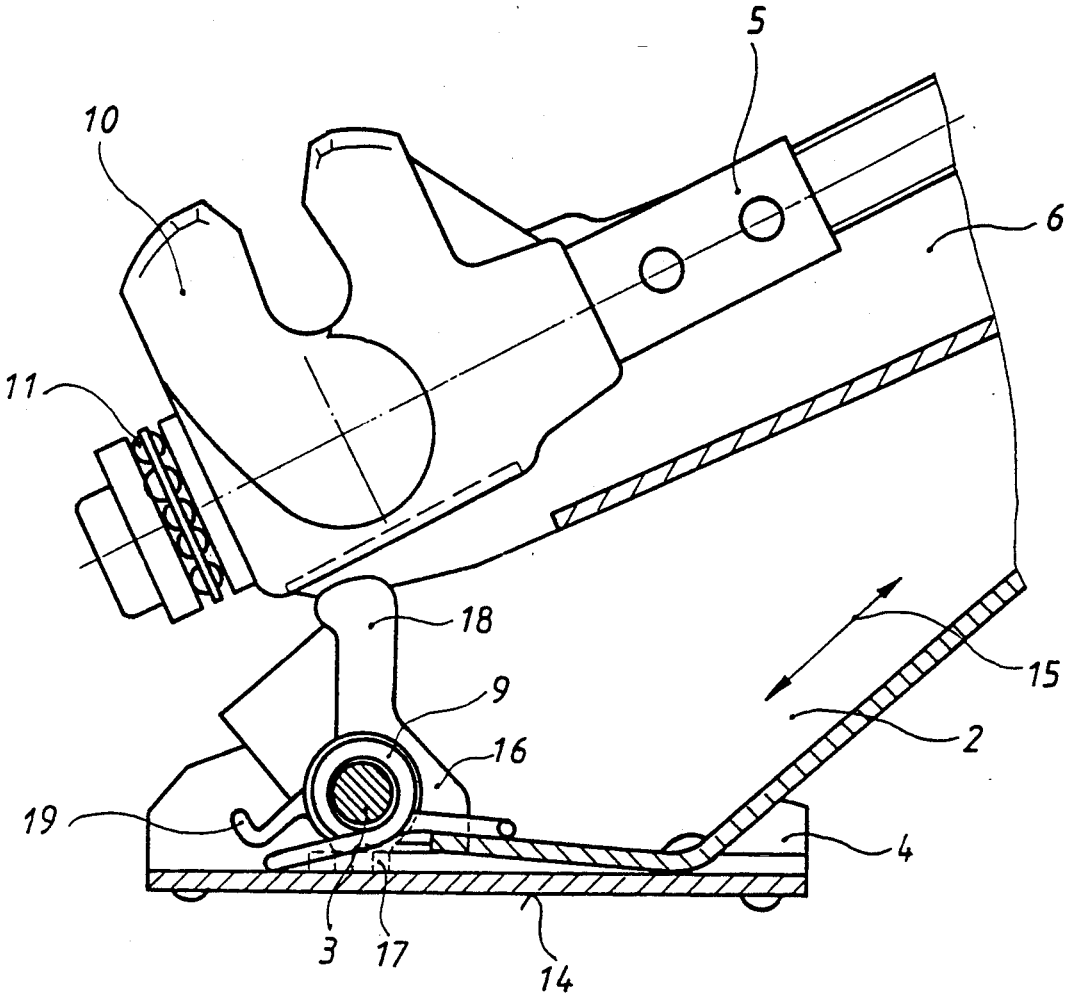
FIG. 2 is a section through the bottom of the jack illustrated in FIG. 1 and in the ready state.

FIG. 2 illustrates details at the bottom of the jack. The figure shows the jack ready to use, with load-interception head 10 slightly above base plate 4. The jack is introduced in this state below the vehicle and is in the correct position for lifting. Mechanism 5 extends through load-interception head 10, which articulates it to the supporting arm. It is as hereintofore mentioned in the form of a threaded shaft and rests at the bottom on a ball bearing 11. At the upper end is an adjusting nut 12. The shaft terminates in a head 13, which a crank for example can be secured to.

Spring mechanism 9 is designed to rest against upright 2 with its free end, and against base plate 4. The spring will force the sole 14 of the disengaged base plate 4 illustrated in FIG. 2 along the length 15 of upright 2.

The base plate has a stop 16. The stop in the illustrated embodiment is a separate component. It has a bore that accommodates articulation 3, which is in the form of a pin, and is secured to base plate 4 by a clip 17. Stop 16 has an upward-pointing finger 18 that rests against the bottom of load-interception head 10 when tensioned.

Figure 3:
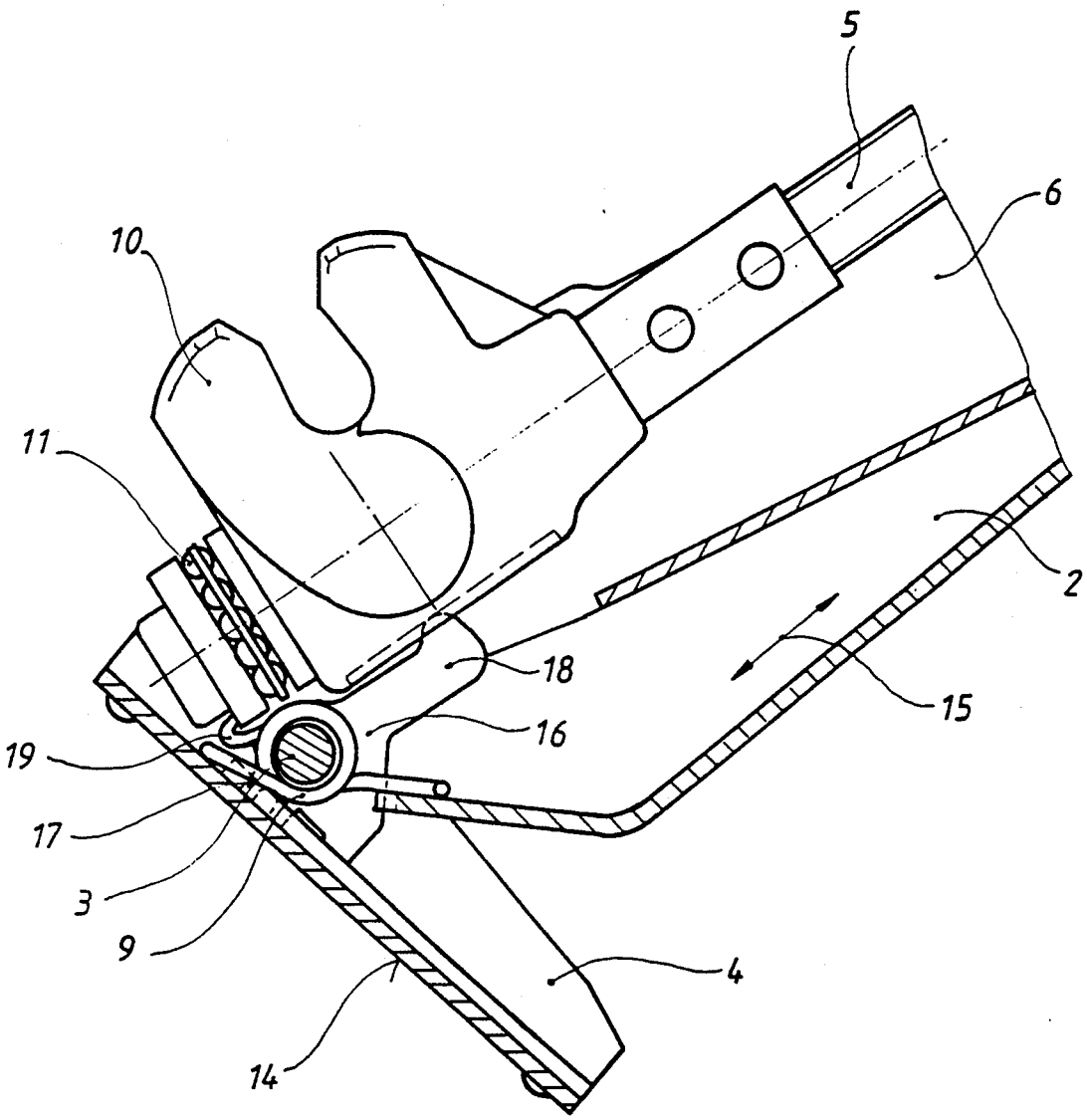
FIG. 3 is a section similar to that in FIG. 2 through the jack in the stowing state.
Figure 4:
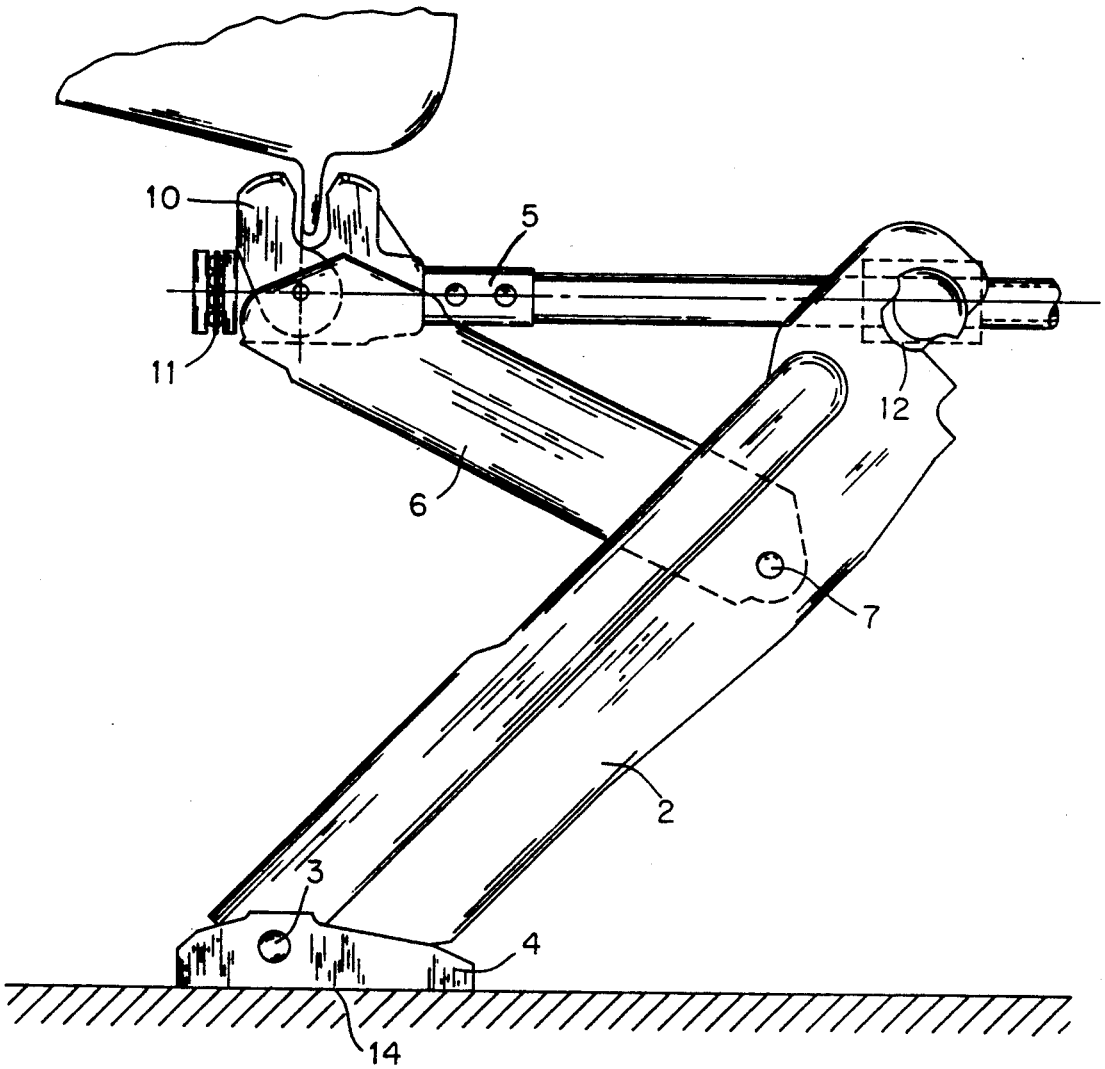
FIG. 4 is an elevational view of the automotive jack shown in FIG. 1, when extended into a position in which it is used.

Load-interception head 10 will rest tight against finger 18 once the jack has been folded together into the stowage state illustrated in FIG. 3, pivoting base plate 4 against the force of spring mechanism 9 and at an angle to the length 15 of upright 2. In this state, the bearing mechanism is disengaged and loose. The mechanism is prevented from rattling around while the jack is in this state by a resilient hook 19 that engages behind the bottom of the drive mechanism.

I claim:

1. An automotive jack comprising: an upright member with a bottom; a base plate with a sole pivotable about a first pivot on said bottom of said upright, member; a supporting arm pivotable about a second pivot on said upright member; actuating means for pivoting said supporting arm about said second pivot; spring means for pivoting said sole of said plate about said first pivot to a position wherein said sole and said plate lies along a length of said upright member; a stop fastened to said base plate; said supporting arm having at one end a load carrying interception head for abutting said stop and pivoting said base plate against a force of said spring means into a position wherein said base plate and sole are inclined at an angle to said length of said upright member when the jack is folded together, said sole of said base plate having an entire surface abutting against a base support due to said pivoting said base plate about said first pivot for any load carried by said jack and any load-carrying position of said jack.

2. An automotive jack as defined in claim 1, wherein said stop is a part of said base plate.

3. An automotive jack as defined in claim 1, wherein said stop is a separate element attached to said base plate.

4. An automotive jack as defined in claim 3, including a clip for attaching said stop to said base plate.

5. An automotive jack as defined in claim 1, wherein said stop has a bore; a shaft extending to said bore in said stop and forming said first pivot between said upright member and said base plate.

6. An automotive jack as defined in claim 1, wherein said stop has a hook engaging a rear side of said supporting arm when said jack is folded up.

7. An automotive jack as defined in claim 6, wherein said hook comprises a resilient member.

8. An automotive jack comprising: an upright member with a bottom; a base plate with a sole pivotable about a first pivot on said bottom of said upright member; a supporting arm pivotable about a second pivot on said upright member; actuating means for pivoting said supporting arm about said second pivot; spring means for pivoting said sole of said plate about said first pivot to a position wherein said sole and said plate lies along a length of said upright member; a stop fastened to said base plate; said supporting arm having at one end a load carrying interception head for abutting said stop and pivoting said base plate against a force of said spring means into a position wherein said base plate and sole are inclined at an angle to said length of said upright member when the jack is folded together, said sole of said base plate having an entire surface abutting against a base support due to said pivoting of said base plate about said first pivot for any load carried by said jack and any load-carrying position of said jack; a clip for attaching said stop to said base plate, said stop being a separate element attached to said base plate; a shaft extending through a bore in said stop for forming said first pivot between said upright member and said base plate; said stop having a hook engaging a rear side of said supporting arm when said jack is folded up, said hook being resilient.

* * * * *